US006378730B1

(12) United States Patent
Reddy et al.

(10) Patent No.: US 6,378,730 B1
(45) Date of Patent: Apr. 30, 2002

(54) QUICK-LOCKING DEVICE FOR EFFECTING HYGIENIC TRANSFER OF FLOWABLE MATERIAL FROM A CONTAINER BY PIERCING

(75) Inventors: Balakrishna Reddy, Ridgefield, CT (US); Randall L. Morrison, Sylmar, CA (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 09/698,318

(22) Filed: Oct. 27, 2000

(51) Int. Cl.[7] ..... B67D 5/00
(52) U.S. Cl. ..... 222/83; 222/541.9; 222/566
(58) Field of Search ..... 222/81, 83, 89, 222/153.07, 541.9, 566, 90

(56) References Cited

U.S. PATENT DOCUMENTS

| | | | | | |
|---|---|---|---|---|---|
| 3,973,698 | A | | 8/1976 | Kato | 222/91 |
| 4,214,675 | A | | 7/1980 | Schmit | 222/83 |
| 4,257,535 | A | * | 3/1981 | Mellett | 222/92 |
| 4,265,372 | A | | 5/1981 | Wainberg | 222/82 |
| 4,316,555 | A | | 2/1982 | Smith | 222/83.5 |
| 4,322,018 | A | | 3/1982 | Rutter | 222/83 |
| 4,355,737 | A | | 10/1982 | Pongrass et al. | 222/81 |
| 4,375,864 | A | * | 3/1983 | Savage | 222/81 |
| 4,441,631 | A | | 4/1984 | Hosie | 222/86 |
| 4,469,249 | A | | 9/1984 | Malpas et al. | 222/83 |
| 4,493,438 | A | | 1/1985 | Rutter | 222/83 |
| 4,516,691 | A | | 5/1985 | Christine et al. | 222/83.5 |
| 4,530,525 | A | | 7/1985 | Schneider | 285/200 |
| 4,589,185 | A | | 5/1986 | Schneider | 29/432 |
| 4,696,411 | A | * | 9/1987 | Graf et al. | 222/81 |
| 5,325,995 | A | | 7/1994 | Harrison et al. | 222/81 |
| 5,393,101 | A | | 2/1995 | Matkovich | 285/3 |
| 5,497,909 | A | | 3/1996 | Wirsig et al. | 222/82 |
| 5,553,740 | A | | 9/1996 | King et al. | 222/1 |
| 5,636,771 | A | * | 6/1997 | Gordon et al. | 222/541.5 |
| 5,671,770 | A | | 9/1997 | Rusche et al. | 137/318 |
| 5,732,853 | A | | 3/1998 | Ganzeboom et al. | 222/82 |
| 5,810,398 | A | | 9/1998 | Matkovich | 285/3 |
| 5,855,223 | A | | 1/1999 | Halonen | 137/318 |
| 5,878,915 | A | | 3/1999 | Gordon et al. | 222/82 |
| 5,967,368 | A | | 10/1999 | Guillermier | 222/81 |
| 6,021,923 | A | | 2/2000 | Shipway | 222/83 |

FOREIGN PATENT DOCUMENTS

| | | | | |
|---|---|---|---|---|
| CA | 1 206 923 | | 7/1986 | |
| CA | 1 233 434 | | 3/1988 | |
| CA | 1 239 618 | | 7/1988 | |
| EP | 0 410 770 | | 1/1991 | |
| GB | 2 154 991 | | 9/1985 | |
| GB | 2154991 A | * | 9/1985 | B67B/7/48 |
| GB | 2 163 136 | | 2/1986 | |
| GB | 2 193 718 | | 6/1987 | |
| GB | 2 283 077 | | 4/1995 | |
| JP | 9104474 | | 4/1997 | |
| JP | 9240789 | | 9/1997 | |
| WO | WO 81/02418 | | 9/1981 | |

* cited by examiner

*Primary Examiner*—Philippe Derakshani
*Assistant Examiner*—Patrick Buechner
(74) *Attorney, Agent, or Firm*—Winston & Strawn

(57) ABSTRACT

A device for effecting transfer of material from a container by piercing the container. The device includes a fitment member that includes a portion having a bore and a base end capable of being attached to a container; a spout member that has a piercing end; and a portion of tube having an outer surface capable of mating in axial relationship with the portion of bore of the fitment member so as to form mating surfaces. The device preferably has a locking assembly that is adapted to lock the fitment and spout members together in a position whereby the piercing end is in piercing engagement with the container. The device also includes at least one sealing member that is arranged to seal the portion of tube and the portion of bore in a position between the locking assembly and the piercing end so as to leave the mating surfaces downstream including the locking assembly substantially cleansed of the flowable material.

20 Claims, 4 Drawing Sheets

QUICK-LOCKING DEVICE FOR EFFECTING HYGIENIC TRANSFER OF FLOWABLE MATERIAL FROM A CONTAINER BY PIERCING

FIELD OF THE INVENTION

The invention relates to the transfer of flowable material from a container by piercing of the container. The invention more particularly relates to the transfer of food materials from a container to a dispensing place in food service or clinical nutrition which uses the principle of piercing the container at the time the dispensing is required.

BACKGROUND OF THE INVENTION

In food service and clinical nutrition, food containers such as pouches are often used for storing in bulk food or nourishing products in an hygienic and convenient manner. The dispensing of the flowable material from the container is an important issue which may be at the origin of serious contamination and sanitary problems if not seriously regarded. Therefore, the flowable material should be transferred from the container to the place of dispense using a reliable system which prevents any possible leakage and keeps the edible content away from the surrounding.

Pre-assembled devices comprising a piercing member engaged in a fitment member in a pre-piercing position are known. Such devices suffer from several drawbacks. They are usually more easily sensitive to the contamination prior to the first dispensing due to the number of pieces involved and pre-assembled together. They are also complicated, expensive to manufacture and cumbersome.

Attempts have been made to develop simpler transfer devices which effect the transfer from a source thereof by piercing which comprises a set of separate parts which are assembled by the operator to carry out the transfer at the time of dispense. U.S. Pat. No. 6,021,923 relates to a transfer device of this kind which comprises a hollow fitment part, a piercing part adapted to fit within the hollow fitment part, two spaced apart sealing means along the device to obviate flow of material past the fitment during transfer. This device art further comprises an internal thread arranged along a significant internal length of the assembly to make the connection between the fitment part and the piercing part. The piercing of the container is obtained by screwing the piercing part into the fitment part to a fully "home" position. Due to the presence of the thread, the flowable material has a natural tendency to leak during transfer by passage over the outside of the thread. The leakage of the material is prevented from pursuing its travel out of the device by the two sealing elements which are located downstream of the thread and which offer both a wiping and sealing action. Such a device is not entirely satisfactory. Indeed, a significant portion of the fitment corresponding to the thread portion can be potentially occupied by the flowable material during transfer which therefore does not offer to the user a reliable and safe situation. Indeed, the greater the surface of the spout in contact with the material, the higher the risk of subsequent contamination. In order to ensure no liquid can escape out of the assembly, the device of the prior art provides a pair of sealing elements in a position downstream of the thread thereby rendering the device more complicated and costly. The fitment must also be relatively long to ensure a proper connection by the thread which is not suitable if one wants to reduce the width of the pouches. A misengagement by screwing may also immediately cause a potential leakage problem as the sealing elements may also be misaligned into the fitment bore. Finally, the assembling operation of the transfer device is relatively time consuming.

The present invention endeavors to provide a transfer device for flowable materials which can be assembled in piercing engagement while providing a cleaner visual perception of the transfer device. The invention also aims at assembling the transfer device more rapidly and more conveniently than the device of the prior art while conferring a reliable and hygienic transfer. Furthermore, the device of the present invention may be of a simpler construction with less sealing hurdles needed and of a shorter overall dimension. The invention also aims at reducing the risk of misengagement of the parts which would cause immediate contact of the material with its surrounding. Finally, the invention also aims at improving the degree of safety and reliability of the transfer device.

SUMMARY OF THE INVENTION

The present invention provides a device for effecting transfer of material from a container by piercing said container comprising a fitment member comprising a portion having a bore and a base end capable of being attached to a container and a spout member comprising a piercing end and a portion of tube having an outer surface capable of mating in axial relationship with the portion of bore of the fitment member so as to form mating surfaces. The device preferably has a locking assembly adapted to lock the fitment and spout members together in a position whereby the piercing end is in piercing engagement with the container. Also, a sealing member is arranged to seal the portion of tube and the portion of bore in a position between the locking assembly and the piercing end so as to leave the mating surfaces downstream including the locking assembly substantially cleansed of the flowable material.

Therefore, the invention provides a simple construction in which the sealing is carried out in a position upstream the locking of the transfer device thus obviating to possible introduction of material along a significant part of the transfer device. The locking assembly is therefore maintained cleansed thereby promoting safety and reliability. Misalignment during fitting of the two members is also reduced as the sealing member may also play the role of centering the spout member with respect to the fitment member before the locking is completed.

Preferably, the assembling operation of the transfer device may be rendered even more rapid and convenient by considering a locking assembly which comprises a snap-fitting assembly including at least one raised surface capable of resiliently engaging a recess surface as a response to the axial pushing of the spout member with the fitment member. Even more preferably, the raised and recess surfaces are both located at a flexural end of the fitment member which is substantially opposite the base end of the fitment member. Therefore, the flexure of fitment is facilitated in such a location thereby making the device easier to engage and limiting the required efforts for securing the device. The transfer device may consequently have a shorter connecting portion located in a less sensitive part of the device which offers the opportunity to reduce the overall width of the container when equipped with the device.

In a preferred embodiment, the raised surface may be a part of the flexural end of the fitment member whereas the recess surface may be a part of the second spout member. Alternatively, the raised surface may also be a part of the spout member and the recess surface a part of the fitment member.

To establish a closed and non-contaminated environment within the fitment member, the fitment member may advantageously comprise a closing element removably attached to the flexural end of the fitment member; said element providing an airtight seal of the interior of the bore portion when the base end of the fitment member is attached to the container. Therefore, before the transfer device is assembled; i.e., by piercing the fitment member with the spout member, the fitment member which is in a connecting arrangement with the container is maintained closed and clean from external environment.

In another preferred embodiment, the closing element is removably connected to the raised portion of the snap-fitting assembly and comprises a pull-off tab to be manually removed before engaging the spout member. The fitment member and the closing element are preferably made of a single integral molded plastic while leaving a tearing zone which demarcates the contour of the closing element. In an alternative, the closing element could also be a removable element attached to the fitment by connection means such as adhesive, welding or any other suitable means.

Due to the upstream location of the sealing member with respect to the locking assembly, the sealing member may comprise a single circumferential sealing element while conferring a sufficient sealing and cleansing action along the bore surfaces of the fitment member. Of course, two or more sealing elements could also be provided although this is not necessary according to the construction of the invention. The sealing member may be carried by the spout member or alternatively by the fitment member or both. The sealing member may preferably be formed of an integral substantially resilient flange or alternatively be a bead or any other suitable means.

The device may be made of any suitable transparent or translucent plastic material which enable to visually control the proper transfer of material while also ensuring a clean perception to the user when the device is in operation.

The invention also relates to a spout/fitment assembly for dispensing a fluid material from a container to a point of dispense by piercing a membrane wall of the container, comprising a hollow fitment having a first end adapted to be attached to the container and a second end, a removable closing member arranged to close the second end and which leaves at least one raised surface when removed, a hollow spout capable of mating with the fitment after the closing member is removed, and means adapted to fit the raised surface to lock the spout in the dispensing position.

BRIEF DESCRIPTION OF THE DRAWINGS

The above and other features and objects of the invention will be apparent to those skilled in the art to which this invention pertains from the following detailed description and the drawings.

DESCRIPTION OF THE PREFERRED EMBODIMENT

Figure 1:
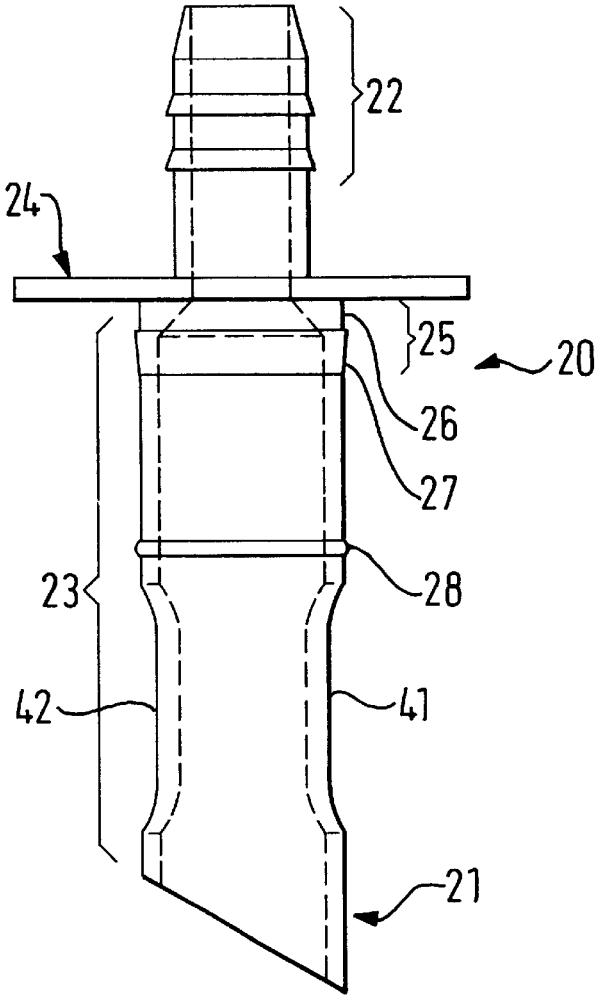
FIG. 1 is a longitudinal view of a spout member of the present invention according to the preferred mode.
Figure 3:
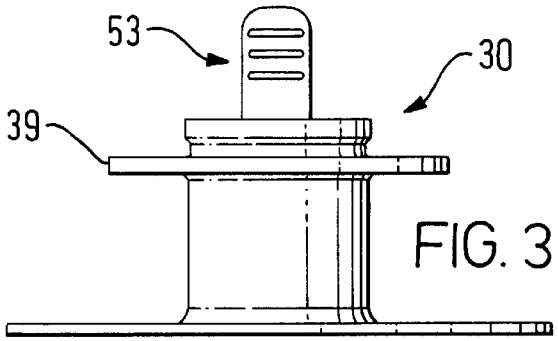
FIG. 3 is a longitudinal view of a fitment member of the present invention.
Figure 7:
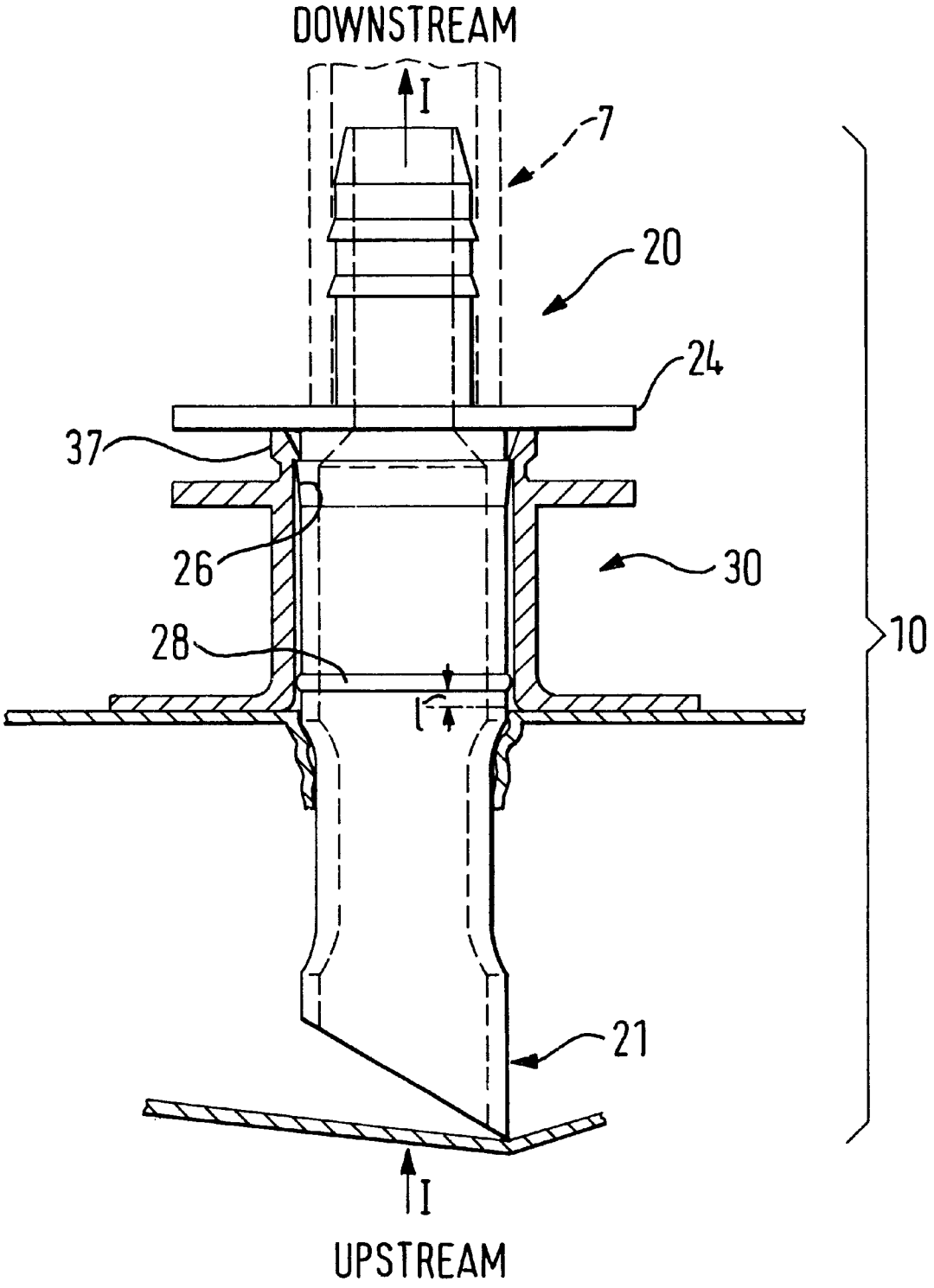
FIG. 7 is a side view of the transfer device of FIGS. 1 and 3 when assembled.

Referring in detail to the drawings, the numeral 10 indicates the transfer device or set as first shown in FIG. 7, the numeral 20 indicates the spout member as first shown in FIG. 1 and the numeral 30 indicates the fitment member as first shown in FIG. 3. As illustrated, the transfer device of the invention is thus composed of two main pieces, namely the fitment member 30 and the spout member 20 which when assembled together form a tight assembly establishing the fluid communication from a container to a point of dispense. The material to be dispensed may be of any kind such as food, drink or clinical solutions from a container which is usually a pouch or bag which comprises a pierceable membrane wall.

Figure 2:
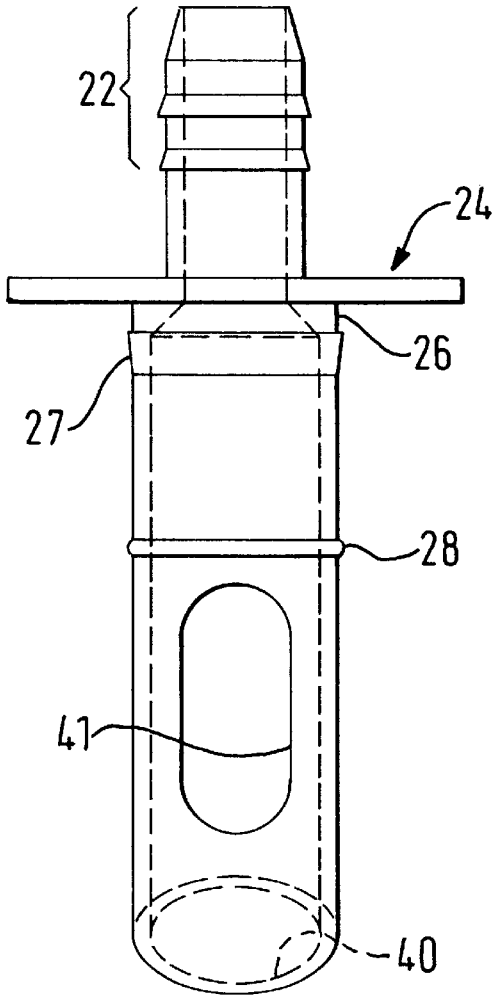
FIG. 2 is a longitudinal view of the spout of FIG. 1 after ¼ revolution about its longitudinal axis.

The spout member of FIGS. 1 and 2 comprises a hollow portion of tube terminating at a first end by a sharpened edge forming a piercing end 21 and at the opposite end by a delivery portion comprising a gland 22 adapted to be connected to a flexible dispensing hose (not shown). An outwardly extending flange 24, preferably annular, is provided below the delivery portion to demarcate below a portion of tube 23 of substantially larger outside diameter which substantially corresponds to the engaging portion of the spout member. There is provided in a limited short zone 25 of the portion of tube 23 and adjacent the annular flange 24, a recess surface 26 forming part of the snap-fitting assembly as will be discussed later in the description. A first end of the recess surface is demarcated by the flange 24 whereas a second end of the recess surface is demarcated by a circumferential ramp 27 tapered in a direction from the annular flange to the piercing end.

Further down toward the piercing end is provided a sealing means in the form of an integral substantially resilient protruding element 28. According to the invention, the sealing means is spaced apart the recess surface a certain distance such as to leave a "clean" portion of tube therebetween which, in engaging operation, could normally not be soiled with the flowable material. The remaining portion of tube below the sealing means represents the part of the spout member which is within the cavity of the container. The piercing end is therefore terminated by a substantially circular opening 40 to allow passage of the fluid therein. Two opposed apertures 41, 42, preferably of oblong shape, may be further provided along the side of the remaining portion of tube to increase the flow rate through the spout member and also to facilitate the emptying of the container when little material is still in the container.

Figure 4:
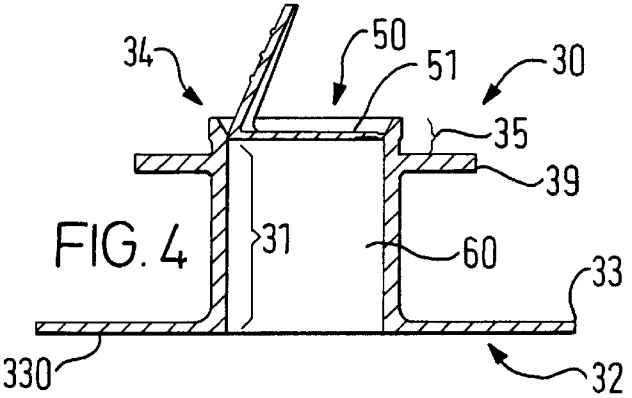
FIG. 4 is a cross-sectional view of the fitment member of FIG. 3.
Figure 6:
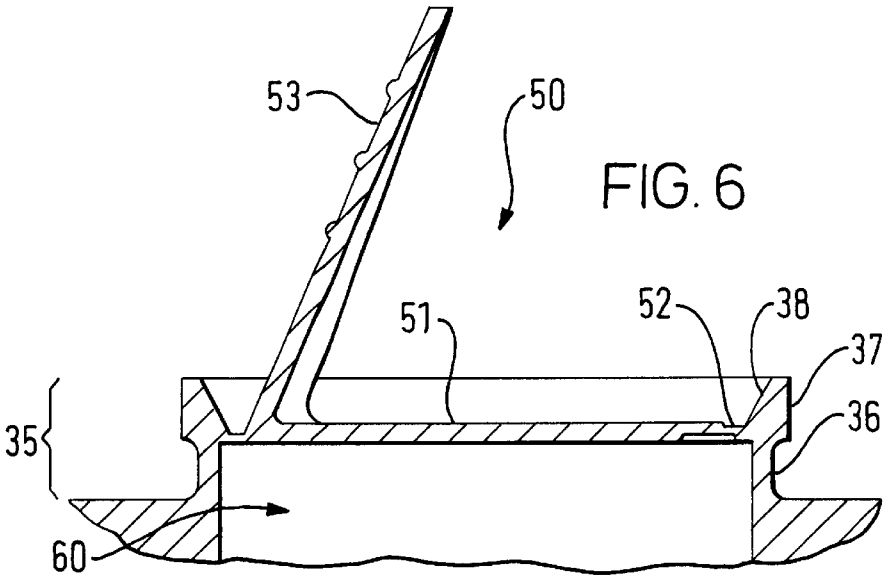
FIG. 6 is a cross-sectional view of a detail of the closure means of the fitment member.
Figure 5:
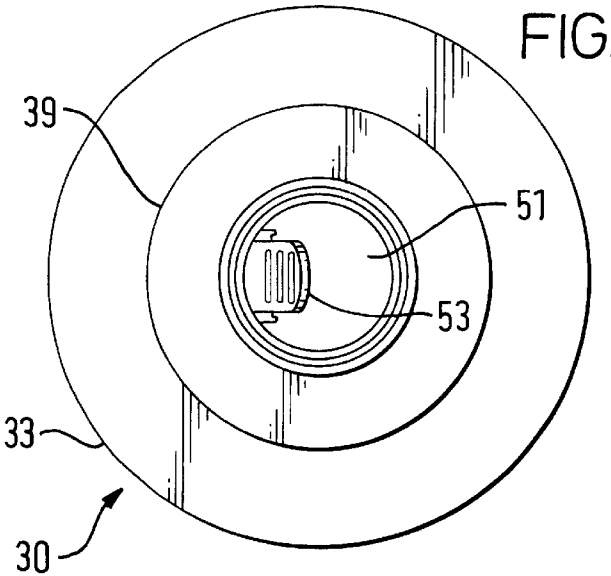
FIG. 5 is a top view of the fitment member of FIG. 3.

Turning now to the fitment member of FIGS. 4 to 6, there is provided a portion having a bore 31 for receiving at least a part of the portion of tube 23 of the piercing spout member therein. The portion of bore is terminated at a first end by a base end 32 comprising a enlarged flange 33. The flange 33 has a flat annular outer surface 330 adapted to be secured to the outer surface of a container in a suitable manner as for example by means of ultrasonic welding, adhesives, heat welding, solvent welding or any heat resistant joining technique. The connection between the flange and the container should withstand sterilizing conditions of the container normally carried out before or after filling of the container with the flowable material.

At its second end 34, opposite to the first end 32, the fitment member terminates by a flexural short portion 35. The portion 35 has a circumferential first zone of reduced thickness 36, at the base of the flange 39, followed by an adjacent end portion of enlarged thickness 37. The end portion 37 comprises an inwardly tapering surface 38 to promote the centering of the spout member during introduction, particularly to favor the proper engagement and sliding of the sealing means which is engaged at first within the fitment in contact with the inner surfaces of the bore. A large diameter collar or flange 39 is further provided below the flexural end 35 which serves for firmly handling the fitment member during the assembling operation.

In the condition of storage of the container, the fitment member is at one end sealingly attached to the container surface and at the other opposite end closed by a closure assembly 50 which prevents any possible introduction of dust, water or contaminant coming from the outside environment before the transfer is carried out. For that, the closing assembly 50 preferably comprises a cover element 51 removably attached to the flexural end 35 of the fitment member forming an airtight seal of the interior 60 of the portion of bore. The cover element 51 is preferably molded as an integral piece of the fitment member with a circular groove 52 delimiting the contour of the cover. A pull tab 53 is further provided attached to one side of the cover element which is to be pulled off to tear the cover element 51 along the circular groove 52. The tab may preferably protrude a certain distance and may include a textured surface to facilitate the gripping. The cover member ensures the safety of the flowable product and prevents contamination from entering the fitment bore before the spout member is introduced to pierce the container and dispense the flowable material. The cover member may also prevent accidental puncturing of the membrane wall during storage and transport of the container.

Figure 8:
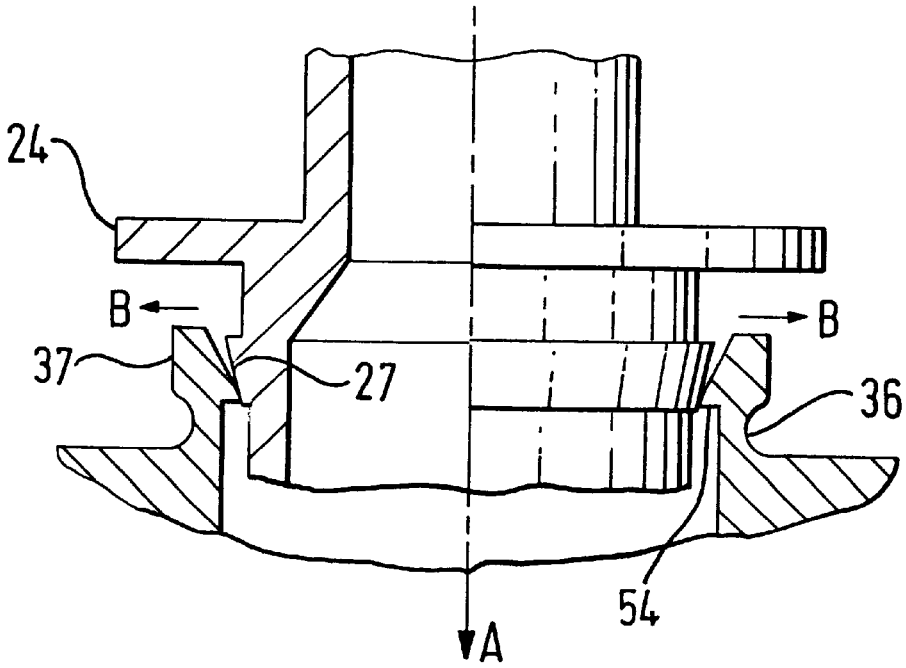
FIG. 8 is a view of detail during snap-fitting engagement of the spout member within the fitment member.
Figure 9:
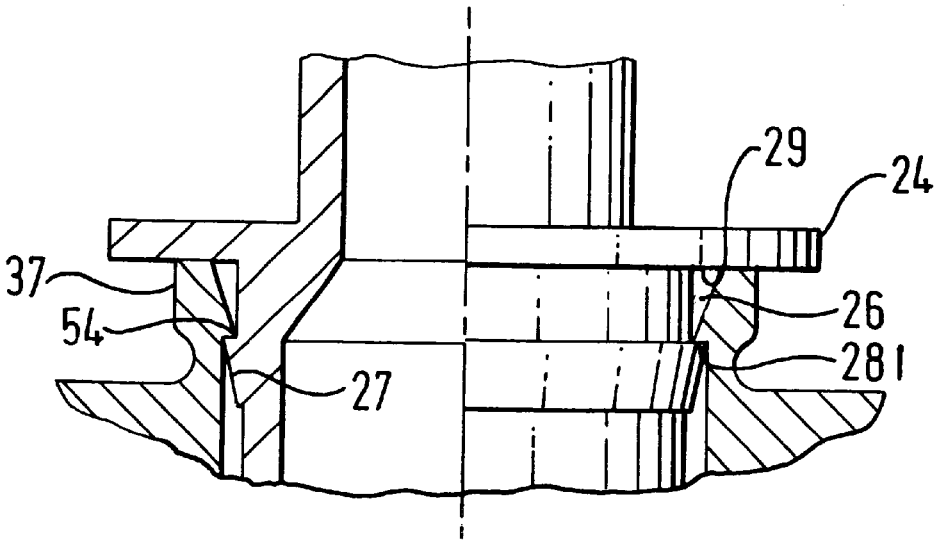
FIG. 9 is a view of detail when snap-fitting engagement of FIG. 8 is completed.

According to one beneficial aspect of the invention, the cover element when removed is adapted to leave the locking peripheral surface. More specifically, due to the presence of the circular groove 52 which is slightly offset inwardly with respect to the bore surface 31, the action of tearing the cover element leaves the inside of the flexural portion with a raised surface in the form of an inwardly protruding barb or neck 54 as best seen in FIGS. 8 and 9. This protruding barb 54 is configured in shape and dimensions to engage the recess of the spout member so as to lock it in the final position of dispense as illustrated in FIG. 7.

More specifically, FIGS. 7 to 9 illustrate the mode of assembling of the transfer device which provides an easy, secure and rapid fitting as opposed to the known systems of the prior art. In the locking mode, the transferring device is in operation for transfer without further action needed. The locking mode is of the type of "push-lock" principle with only one single relative position of the spout member with respect to the fitment member. Therefore, the locking mode defines the length of engagement of the piercing portion within the container and the suitable position for the sealing means. As illustrated in FIG. 7, as the spout member 20 is advanced, the piercing end 21 cuts away the film and provides a large opening for allowing the flow of material to pass thereto. The direction of the flow is indicated by arrow I in FIG. 7 and it exits spout member 20 into dispensing tube 7. In the present application, the terms "downstream" and "upstream" generally refer to a location determined in reference to the direction I of the flow of material upon transfer. The circumferential sealing element 28 is located in a position along the portion of bore 31 as close as possible of the pierced region of the container thus leaving no or at least a very limited length "1" of interstitial space between the fitment and spout members for the material to enter. As a result, the fitment appears from the users's view always clean and the safety zone for the material from the surrounding is advantageously kept maximum.

FIG. 8 shows the spout member at the time of the assembling which has its ramp 27 opposing a progressive force radially as the spout member is pushed manually in the axial direction A. The radial force generated by the ramp 27 causes the resilient flexion of the flexural ends 37 along outward radial direction B. After a sufficient motion of the spout along direction A of the spout member is carried out to overcome the resistance of the flexural ends until the limit of the ramp, the snap fitting is obtained by engagement of the raised surface 54 within the recess as best shown in FIG. 9. A snap is perceivable by the user which corresponds to moment the flexural ends comes to their initial position and the raised surface 54 abuts against the abrupt side 281 delimiting the recess 26 and the ramp 27. Therefore, the snap indicates to the user the transfer device is successfully assembled and the transfer takes place. The spout member is prevented from entering further thanks to the flange 24 of the spout member which forms an abutting surface 29 of the recess portion for the flexural end of the fitment member.

The container is preferably a supple pouch made of one or more heat resistant plastic foils. The foils may advantageously have barrier layer(s) against water and gas. The container may have various shapes such as relatively flat or have a cubic shape. It is preferred the pouch lays flat for better heat-up characteristics. As illustrated in FIG. 7, the pierced end may also serve to held the back side of the pouch spaced apart the front side of the pouch to prevent the pouch from collapsing and therefore ensuring complete emptying of the pouch from the foodstuff. The material for the pouch should be resilient enough not to puncture easily in the back side but not too much to still permit piercing when the spout is engaged in the fitment. In a preferred embodiment, the pouch may be of polyamide/EVOH/polyamide.

In the food service field, the transfer device of the invention is intended to equip food or beverage pouches to effect transfer in a dispensing system such as a sauce or beverage dispenser and the like. For that, the fitment member may be automatically attached in a form/fill/seal pouch machine during manufacturing of the pouch.

A method and means for attaching fitments to bags on packaging machinery at high speed is described in U.S. Pat. No. 3,894,381 to Christine et al.; the content of which is incorporated herein by reference. Filling of the pouch may be carried out while producing the pouch such as by means of a pipe before the upper part of the pouches is sealed.

The spout member of the invention may be separately packed, preferably in sterile conditions, within a separate plastic bag. In order to reduce excessive manual operations, a hose (illustrated by reference numeral 7 in FIG. 7) may be already connected to the gland of the spout member when sterilized and then packed in the plastic bag. The operator in the catering area may thus receive both the food pouch with its fitment member sealed thereon and the spout member packed in its separate bag. If the food or beverage is to be dispensed hot or warm, the pouch is usually installed in the dispensing machine without its spout member until the pouch has reached the temperature of service; i.e., about 55–65° C. Then, to effect transfer to the point of use, the operator may carry out the connection of the spout member in hot conditions, again to prevent any possible bacterial contamination of the food.

The invention described and claimed herein is not strictly limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A device for effecting transfer of material from a container by piercing said container comprising:

a fitment member comprising a portion having a bore and a base end capable of being attached to a container;

a spout member comprising a piercing end and a portion of tube having an outer surface capable of mating in axial relationship with the portion of bore of the fitment member so as to form mating surfaces;

a locking assembly adapted to lock the fitment and spout members together in a position whereby the piercing end is in piercing engagement with the container, wherein the locking assembly comprises a snap-fitting assembly including at least one raised surface capable of resiliently engaging a recess surface as a response to the axial pushing of the spout member within the fitment member; and at least one sealing member is arranged to seal the portion of tube and the portion of bore in a position between the locking assembly and the piercing end so as to leave the mating surfaces downstream including the locking assembly substantially cleansed of the flowable material.

2. The device according to claim 1, wherein the sealing member comprises a single circumferential sealing element.

3. The device according to claim 1, wherein the base end comprises an enlarged portion of flange with a surface adapted to form a sealing surface against a surface of the container.

4. The device according to claim 1, wherein the container is a flexible pouch containing a food product.

5. The device according to claim 1, wherein the spout member comprises an outer gland adapted for fitting of a dispensing tube thereof.

6. The container comprising a device according to claim 1, wherein the fitment member is sealingly attached to the container.

7. The device according to claim 1, wherein said raised and recess surfaces are located at a flexural end of the fitment member substantially opposite the base end of the fitment member.

8. The device according to claim 7, wherein said raised surface is a part of the flexural end of the fitment member whereas the recess surface is a part of the spout member.

9. The device according to claim 7, wherein the spout member comprises a flange extending circumferentially from said portion of tube which forms an abutting surface of the recess portion for the flexural end of the fitment member and thereby limits the length of introduction of the spout member within the fitment member.

10. A food container comprising a device for effecting transfer of a flowable food material from it by piercing comprising:

a container that contains a flowable food therein;

a fitment member comprising a portion having a bore and a base end attached to the container;

a spout member comprising a piercing end and a portion of tube having an outer surface capable of mating in axial relationship with the portion of bore of the fitment member so as to form mating surfaces;

a locking assembly adapted to lock the fitment and spout members together by a pushing action exerted on the fitment member in a locking position whereby the piercing end is in piercing engagement with the container; and at least one sealing member is arranged to seal the portion of tube and the portion of bore in a position between the locking assembly and the piercing end so as to leave the mating surfaces downstream including the locking assembly substantially cleansed of the flowable material.

11. A device for effecting transfer of material from a container by piercing comprising:

a fitment comprising a portion of bore;

a spout comprising a piercing end and a portion of tube; said portion of tube being capable of mating in axial relationship with the portion of bore;

a locking assembly adapted to lock the fitment and the spout in a position whereby the piercing end is in piercing engagement; and at least one sealing member between the spout and the fitment;

wherein the locking assembly is located in a position further downstream from the sealing member and is capable of being engaged essentially by exerting a pushing force on the spout axially within the fitment.

12. A device for effecting transfer of material from a container by piercing comprising:

a fitment adapted to be attached to a container;

a spout comprising a piercing end adapted to engage an interior portion of the fitment in an axial relationship;

a locking assembly adapted to lock the fitment and the spout in a position whereby the piercing end is in a piercing engagement; and sealing means between the spout and the fitment to prevent material from escaping out of the device;

wherein the locking assembly secures the spout and fitment together in a single locking position as a result of a pushing force exerted on the spout in an essentially axially direction within the fitment.

13. A container having a wall and including a flowable material therein and comprising the device of claim 12, wherein the fitment is sealingly attached to a wall of the container.

14. A device for effecting transfer of material from a container by piercing said container comprising:

a fitment member comprising a portion having a bore and a base end capable of being attached to a container;

a spout member comprising a piercing end and a portion of tube having an outer surface capable of mating in axial relationship with the portion of bore of the fitment member so as to form mating surfaces;

a locking assembly adapted to lock the fitment and spout members together in a position whereby the piercing end is in piercing engagement with the container; and at least one sealing member is arranged to seal the portion of tube and the portion of bore in a position between the locking assembly and the piercing end so as to leave the mating surfaces downstream including the locking assembly substantially cleansed of the flowable material;

wherein the fitment member comprises a flexural end having a closing element removably attached to the flexural end; the closing element providing an airtight seal of the interior of the bore portion when the base end of the fitment member is attached to the container.

15. The device according to claim 14, wherein the closing element is removably connected to the raised surface of the snap-fitting assembly and comprises a pull-off tab to be manually removed before engaging the spout member.

16. The device according to claim 15, wherein the fitment member and the closing element are made of a single integral molded plastic.

17. An assembly for dispensing a fluid material from a container to a point of dispense by piercing a membrane wall of the container, comprising:

a hollow fitment having a first end adapted to be attached to the container and a second end, a removable closing member arranged to close the second end, wherein the closing member leaves at least one raised surface when removed; and a hollow spout capable of mating with the fitment after the closing member is removed, the hollow spout comprising means adapted to fit the raised surface for locking the spout in a dispensing position.

18. The assembly according to claim 17, wherein the closing member comprises a peel-off cover member which includes a tab portion for gripping.

19. The assembly according to claim 17, wherein the hollow spout has a locking ramp and a recess surface for engaging the raised surface and form a snap-fitting assembly.

20. The assembly according to claim 17, wherein a sealing member is provided between the spout and fitment which is located proximate the first end of the hollow fitment.

* * * * *